United States Patent [19]

Greenfield

[11] Patent Number: 4,750,734

[45] Date of Patent: Jun. 14, 1988

[54] HAND EXERCISER

[76] Inventor: Martin J. Greenfield, 179 Battersea Bridge Road, London S.W.11, England

[21] Appl. No.: 873,429

[22] Filed: Jun. 12, 1986

[30] Foreign Application Priority Data

Jun. 18, 1985 [GB] United Kingdom ..... 8515446

[51] Int. Cl.[4] ..... A63B 21/30

[52] U.S. Cl. ..... 272/67; 272/135

[58] Field of Search ..... 272/68, 67, 143, 135, 272/141; 128/26; 273/67 R, 67 B, 73 D, 73 R, 73 E, 73 C, 76

[56] References Cited

U.S. PATENT DOCUMENTS

| | | | |
|---|---|---|---|
| 2,080,642 | 5/1937 | Timpe | 273/73 D |
| 3,265,389 | 8/1966 | Carlson | 272/68 |
| 3,326,550 | 6/1967 | Melchiona | 272/68 |
| 3,341,201 | 9/1967 | Ryan | 273/67 R |
| 3,820,785 | 6/1974 | Occhipiuti et al. | 273/73 D X |
| 4,033,582 | 7/1977 | Linden | 273/73 D |
| 4,318,875 | 3/1982 | Shrimpton et al. | 273/76 X |
| 4,379,554 | 4/1983 | Schuyler | 273/76 X |
| 4,549,736 | 10/1985 | Lotfy | 273/76 X |

FOREIGN PATENT DOCUMENTS

| | | | |
|---|---|---|---|
| 204113 | 9/1923 | United Kingdom | 273/73 L |
| 2157181 | 10/1985 | United Kingdom | 273/73 E |

*Primary Examiner*—Richard J. Apley
*Assistant Examiner*—Howard Flaxman
*Attorney, Agent, or Firm*—Merchant, Gould, Smith, Edell, Welter & Schmidt

[57] ABSTRACT

A hand exerciser for use in physiotherapy and in muscle building which is suitable for use in exercising of the muscles of the forearm, hand, wrist and fingers comprises a rigid frame (11) spanned by a resiliently deformable web (10) held under tension and formed with an array of cells (12) so as to accommodate human fingers, the web being formed of an elastomer having elasticity and hardness properties which render it capable of deformation when gripped by means of fingers inserted in the cells and appropriately stretched as a result of muscular action.

9 Claims, 3 Drawing Sheets

HAND EXERCISER

This invention relates to hand exercisers and more particularly to exerciser devices for use in strengthening and therapy of the muscles of the forearm, wrist, hand and fingers.

Hand exercise units, herein generally termed hand exercisers, are well known devices employed in the exercising of the muscles. The muscles are brought into operation in the forearm, hand, wrist and fingers as a result of contraction of the hand against the resistance of the hand exercise unit. This resistance is generally offered by steel elements under tension, such as springs, or by rubber balls to be gripped by the hand. These devices are intended to accommodate the hand but are generally limited to a single range of movement as the devices are forced to contract. This limited range of movement accordingly limits the benefit which can be achieved in carrying out exercises using such exercisers. The form of contraction resistance facility offered by the devices soon leads, on repeated use of the device, to those muscles which are exercised achieving a stale condition, nullifying any neuromuscular stimulation which has been achieved and correspondingly nullifying any progress which has taken place. There is generally no provision for accommodating with a single hand exerciser all of the movements associated with the parts of the anatomy in question. It is a universally acknowledged fact in physiotherapy that neuromuscular progress is dependent on the ability to stimulate muscles from different angles with use of different exercises and training principles.

It is an object of the invention to provide hand exercisers which provide for a wide variety of neuromuscular responses without the need for adjustment or resetting of the exerciser, which hand exercisers have utility both in physiotherapy and in muscular strengthening for sports purposes.

According to the present invention, there is provided a hand exerciser for multi-movement exercising of the muscles of the forearm, hand, wrist and fingers, which comprises a rigid frame spanned by a resiliently deformable web held under tension and formed with an array of cells sized to accommodate the human fingers, the web material being an elastomer having elasticity and hardness properties which render it capable of offering variable resistance to deformation according to the positions of fingers inserted in the cells.

The material from which the web is produced will generally be a thermoplastic rubber or elastic plastics elastomer. Such material preferably has a Shorr A hardness of 20° to 80°, an elasticity modulus of from 1 to 10 $MN/m^2$, a tensile strength of from 7 to 35 $MN/m^2$ and an elongation at break of 100% to 1000%. The Shorr A hardness is particularly preferably from 40 to 60. The tensile strength is preferably from 10 to 30 $MN/m^2$. A typical such material is the product MA198 from BTR Limited. The web may be of sheet form with openings stamped or otherwise formed therein or may be a mesh formed of strands of material as aforesaid crossing over at regular intervals and interconnected at the crossover positions.

The webs themselves may be made from a wide variety of materials which meet the requirement of being resilient. In general these include elastomeric materials whether vulcanised or unvulcanised, cross-linked or non-crosslinked or containing a cross-linked or partially cross-linked component. The term vulcanised is used to imply the use of heat and possibly pressure in forming a three-dimensional molecular network, whilst cross-linking covers the formation of a three-dimensional molecular network at any temperature. The composition utilised to produce the web having physical characteristics as aforesaid may contain the usual additives for providing protection against water, ozone and weathering, reinforcing fillers, inert fillers, colourants, antiabrasion agents etc.

The shape of the cells is not important, it being merely necessary that they should accommodate the fingers comfortably. The grid will possess a sufficient number of cells to provide alternative positions for of the hand, each of which positions will result in different muscle operations occurring when the exerciser is operated with the hand in each such position. The cells may be triangular, circular, rectangular, square, hexagonal or octagonal as desired. The most comfortable grip is achieved with cells formed by stamping, moulding or otherwise in a web, the openings thus produced preferably being circular or square with rounded corners. The frame itself can be of any convenient shape, but is preferably circular or rectangular.

A simple form of exerciser embodying the invention is formed by moulding of the web in a mould previously containing a rigid frame around which the moulding composition becomes disposed and cured. This is a particularly suitable procedure when the web is of sheet form, such a form of exerciser being relatively inexpensive to produce and nevertheless capable of permitting a wide variety of muscle movement according to direction of stressing, thickness of web and percentage area of cells in the vicinity of the cells through which the fingers are placed. Different sectors of the exerciser can be subjected to a different tension by forming the frame from separate rigid elements held in an outer frame which is continuous, which rigid elements are held at different distances from the centre of the web. The outer frame can be provided with adjustable tensioning devices connecting it to the inner frame elements, which tensioning elements can be set to varying the spacing of the inner frame element from the centre of the web to the desired extent for applying different tensions to different sectors of the web. Whether the frame has merely a range of different tensions in different sectors preset to specific values or whether these values are variable at will, it can be seen that a device is provided which can offer a variety of resistances to the user who can thus work up through different tensions during a period of operation, with there merely being the need to ensure that one moves the hand to sectors of appropriate tension. If preset and fixed different tensions are provided, sectors of the web can be colour coded accordingly. Alternatively, as a result of the provision of means for varying the tensioning by the user of the exerciser, all the sectors can be set to the same tension which can be varied from time to time as required according to the exercising programme being carried out and/or to enable the exerciser to be used by different people and advantage then taken simply of the different types of exercise permitted by a single tension web.

For a better understanding of the invention and to show how the same can be carried into effect, reference will now be made by way of example only to the accompanying drawings wherein.

Figure 1:
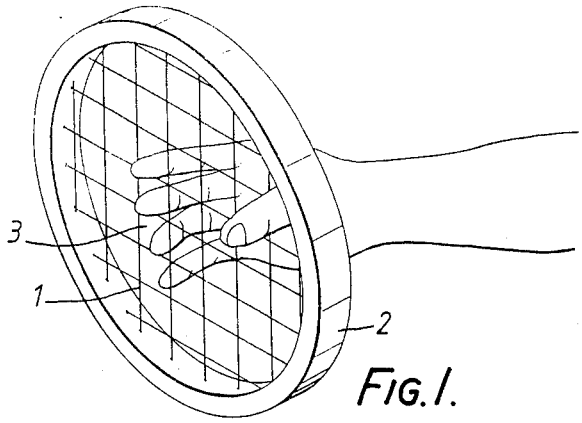
FIG. 1 is a perspective view of a simple form of hand exerciser embodying the invention.

Referring to FIG. 1 of the drawings, the hand exerciser shown therein comprises a web 1 formed as a mesh held within a rigid circular frame 2. The mesh defines a plurality of openings or cells 3 sized to receive the fingers and thumb of the human hand inserted into adjacent or non-adjacent openings 3.

Figure 2:
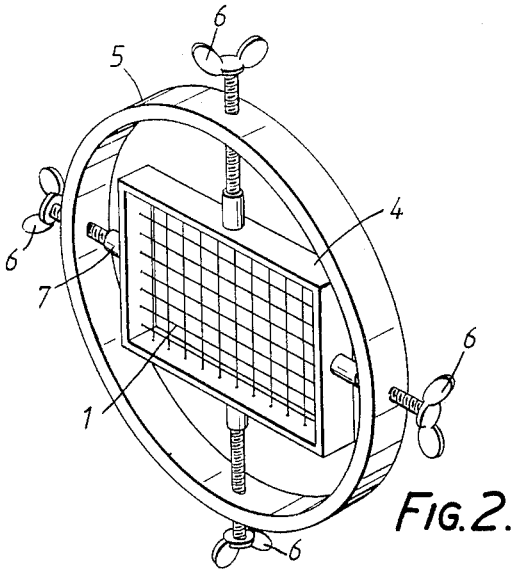
FIG. 2 shows a second form of hand exerciser comprising a mesh structure set within a four sided fixed frame and capable of variable mesh tension.

The form of hand exerciser shown in FIG. 2 comprises a like type of web 1 housed within a rectangular frame 4 held in an outer circular frame 5 by means of wing nutted screw threaded elements 6 passing through openings in the outer frame 5 to enter internally screw-threaded tubular elements 7 centrally positioned on each of the sides of the frame 4 to hold the frame 4 in position and place the web under tension as the screw connection is tightened.

Figure 3:
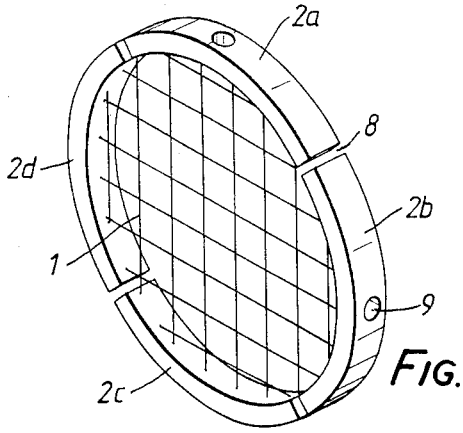
FIG. 3 shows a hand exerciser embodying this invention of circular form having a frame made up of a plurality of segments.
Figure 4:
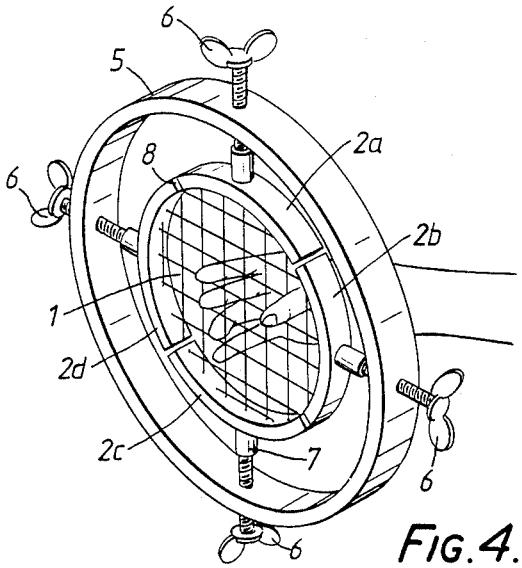
FIG. 4 shows a hand exerciser of the type shown in FIG. 3 having the facility for varying the tension different sectors thereof.

The hand exerciser of FIG. 3 differs from that shown in FIG. 1 in that the frame 2 is formed as four segments *2a, 2b, 2c, 2d* of equal circumferential length and each separated from the adjacent segments by a gap 8. As the frame can itself be forced out of planarity, the scope for exercising the hand with such an exerciser is considerably increased. The frame segments are shown formed with openings 9 in which screw-threaded tubular elements 7 as shown in FIG. 2 can be fitted in producing the form of hand exerciser shown in FIG. 4 which can be regarded as combining the features of FIGS. 2 and 3. As a result of each of segments *2a* to *2d* having its own screw-threaded tension adjuster screw, different areas of the web 1 can be subjected to differing tension and/or uniform tension can be achieved over the magnitude of any such tensioning depending on the adjustment of the screw threaded members 6.

Figure 5A:
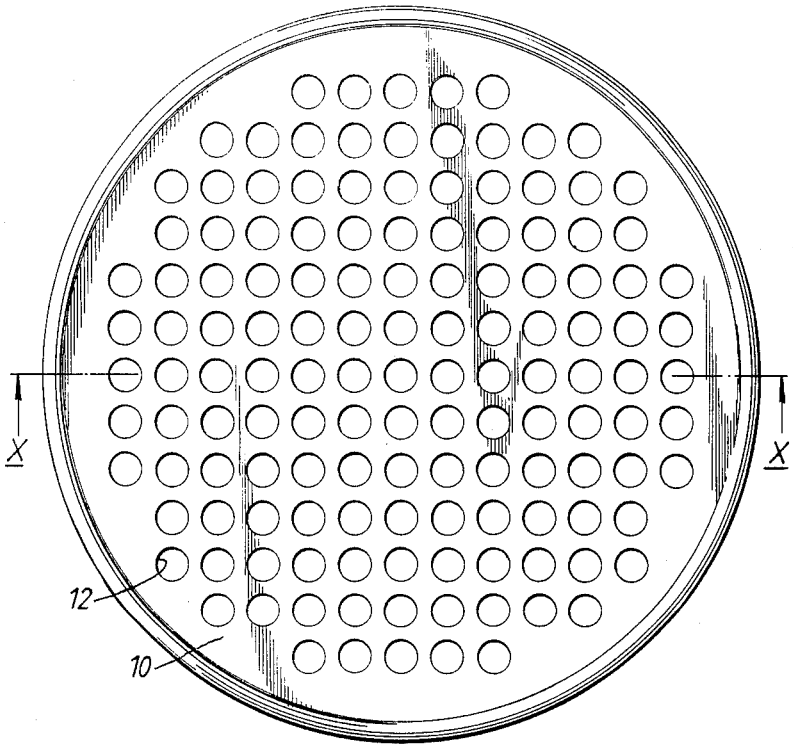
FIGS. 5A and 5B are plan and sectional views through a moulded hand exerciser embodying this invention having a web of sheet form.
Figure 5B:
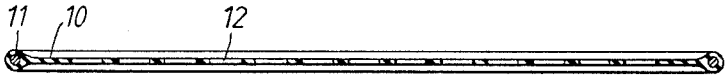

Finally, FIG. 5A and its cross-section at X—X shown in FIG. 5B shows a hand exerciser formed as an integral moulding comprising a sheet 10 of a rubber composition moulded over and between a circular ring 11 and formed with an array of apertures 12 each sized to receive a finger or thumb. The rubber moulding composition, like the material of which the strands of the web 1 shown in FIGS. 1 to 4 are made, will have a Shorr A hardness of 20° to 80°, an elasticity modulus of from 1 to 10 $MN/m^2$, a tensile strength of from 7 to 35 $MN/m^2$ and an elongation at break of 100% to 1000%.

In order to utilise the hand exerciser of the invention, the fingers are inserted into the web openings 3 or apertures 12. As resistance is applied to the fingers by the web, appropriate muscle groups are employed to overcome this resistance. Thus, by using one or both hands, twisting, pulling, pushing movements may be applied to the hand exerciser. By using one or more fingers it is possible to contract the grid in various ways in carrying out scissor movements, curling and related motions. The level of resistance felt within the hand exerciser may, in some of the aforementioned embodiments, be varied by appropriate use of the tension adjuster screws. In the case of the embodiment of FIGS. 5A and 5B, a different level of resistance will be felt at different parts of the web, depending particularly on the influence of any unapertured marginal region of the web.

Indeed the device, if large enough, may also be used by two individuals simultaneously, each placing the fingers into the cells in one area of the grid and then applying tension in opposite directions.

The hand exerciser of the invention is a useful accessory for sufferers of arthritis and rheumatism and may be used in physiotherapy in hospitals. It may also be used in exercising or training by persons whose sporting activities require the use of the hand and forearms, wrist and fingers and is expected to be of special benefit to persons who play golf, cricket, tennis, judo, gymnastics, baseball, swimming, skiing, wind surfing and mountaineering. It is conservatively estimated that over twenty exercises can be performed efficiently with the hand exercisers of the invention, as well as approximately thirty physiotherapy training principles.

The following list of exercises is indicative of those which may be carried out using an exerciser embodying the invention:

1. Insert fingers of hand or hands into elastic grid provided by the web and grip and contract repeatedly.
2. Insert fingers of hand closely spaced into grid and expand outwards, i.e. the opposite of Exercise 1.
3. Insert fingers of one or both hands in an open scissors position into the grid and contract, or use two fingers at a time, one or both hands.
4. Insert fingers in a closed scissors position and expand repeatedly i.e. the opposite of Exercise 3.
5. Insert fingers or finger of hand or hands into grid for curling action, with back of hand resting on the rigid frame.
6. Place palm of hand on the frame and insert thumb into grid and expand outwards.
7. Hold the frame with four fingers of one hand, then use the thumb to contract the grid towards the frame.
8. Hold the frame with four fingers of one hand, then move the thumb to left and right; the thumb can also push down on the grid and achieve the reverse effect.
9. Place the palm of the hand on the frame and grip the grid with the fingers extended and contract. One or more fingers and the hand or hands can be exercised simultaneously. To achieve higher resistance, insert the fingers further away from the frame into the grid then, stretch the grid back until palm of the hand can be anchored to the frame. Alternatively, both hands can be used to contract the grid simultaneously in opposite directions.
10. Place the fingers of one hand underneath one side of the grid, then place a finger from the other hand on top of the other side of the grid and push down with one finger and up with the other.
11. Insert fingers of one hand in a scissor position into the grid, then with the other hand hold the frame and rotate the frame in a circular motion left to right resisting the movement with the inserted hand. A back and forth motion can also be utilised. A variation is to hold the frame firm in one hand and with the other inserted in the scissor position twist the hand left to right and up and down.
12. Insert two fingers or more into the grid and while keeping them stiff move them up and down in a vertical plane. The other hand holds the exerciser steady.

13. Insert a finger into the grid using the frame to anchor the thumb then, while holding the frame steady with the other hand, move the finger in a circular clockwise and anti-clockwise movement.
14. With the exerciser in a horizontal position insert the fingers from underneath through the grid so that the finger tips are positioned on the frame, then while holding the frame firm with the free hand, pull with the fingers raising the knuckles upwards, as if pulling oneself up the edge of a cliff with the finger tips. The free hand that keeps the exerciser steady can also be used to put the grid under tension by contracting the grid and thus increasing the resistance to the exercising hand.
15. The reverse of the above exercise is achieved by placing the frame in the palm of the hand, then inserting the fingers into the upper side of the grid and then pulling or raising the fingers backwards repeatedly.
16. Place the web in the palm of the hand and use the fingers to "walk" pulling successive rows of cells towards the frame and back again to the starting position.
17. With both hands grip the grid and place the frame of the exerciser against the knees and turn the hands downwards.
18. As in Exercise 17, position the frame against the knees and grip the grid and twist in circular motion clockwise and anti-clockwise.
19. The grid is gripped with both hands and the moment of bending is applied as in bending a stick. The exerciser is in the vertical position.
20. Grip the grid with the wrists turned to the side so that the thumbs are laterally upright, then raise the hands up and down as if using a hammer.
21. Place the fingers of both hands on the frame then use the thumbs to "walk" backwards, pulling successive rows of the grid towards the frame and back to the starting position.
22. Two or more people can use the web at once contracting alternately in sequence or simultaneously.

As a guideline with regard to schedules on the web, choose 3–5 exercises and do sets of them and repeat for at least 5 minutes 2–3 times per week, more often if higher performance levels are desired.

After 6–8 weeks the muscles will need a change of routine and appropriate exercises may be chosen to make up a new schedule.

Many more variations and combinations of the exercises described here can be carried out. Practically every known physical training principle can be utilised on the Exerciser, i.e. super sets, tri sets overload, forced reps, pyramids etc.

I claim:

1. A hand exerciser for multi-movement exercising of the muscles of the forearm, hand, wrist and fingers, which comprises a rigid frame spanned by a resiliently deformable flat elastomer sheet moulded therearound and existing in a state of tension, the elastomer sheet being provided with an array of apertures therethrough sized to accommodate the human fingers and being formed of an elastic polymer having elasticity and hardness properties which render it capable of offering variable resistance to deformation out of planar according to the positions of the apertures in which fingers are inserted in deforming the sheet.

2. A hand exerciser according to claim 1, wherein said elastic polymer has a Shorr A hardness of 20° to 80°.

3. A hand exerciser according to claim 1, wherein said elastic polymer has an elasticity modulus of from 1 to 10 $MN/m^2$.

4. A hand exerciser as claimed in claim 1, wherein said elastic polymer has a tensile strength of from 7 to 35 $MN/m^2$.

5. A hand exerciser as claimed in claim 1, wherein said elastic polymer has an elongation at break of 100% to 1000%.

6. A hand exerciser for multi-movement exercising of the muscles of the forearm, hand, wrist and fingers, which comprises a rigid frame spanned by a resiliently deformable flat elastomer sheet moulded therearound and existing in a state of tension, the elastomer sheet being provided with an array of apertures therethrough size to accommodate the human fingers and being formed of an elastomer having a Shorr A hardness of 20° to 80°, and elasticity modulus of from 1 to 20 $MN/m^2$, a tensile strength of from 7 to 35 $MN/m^2$ and an elongation at break of 100% to 1000%.

7. A hand exerciser as claimed in claim 6, wherein the apertures are of circular formation.

8. A hand exerciser as claimed in claim 6, wherein the apertures are of generally square formation.

9. A hand exerciser as claimed in claim 6, whose outer periphery is circular.

* * * * *